United States Patent [19]

Fehrenbach et al.

[11] Patent Number: 4,996,963

[45] Date of Patent: Mar. 5, 1991

[54] PRESSURE REGULATING DEVICE

[75] Inventors: Siegfried Fehrenbach, Markgröningen; Kurt Herbst, Burgstetten; Wolfgang Schulz, Bietigheim-Bissingen; Eberhard Utz, Stuttgart, all of Fed. Rep. of Germany

[73] Assignee: Robert Bosch GmbH, Stuttgart, Fed. Rep. of Germany

[21] Appl. No.: 788,364

[22] Filed: Oct. 17, 1985

[30] Foreign Application Priority Data

Dec. 19, 1984 [DE] Fed. Rep. of Germany ..... 3446325

[51] Int. Cl.[5] ..... F02M 41/00

[52] U.S. Cl. ..... 123/463; 123/447; 138/30

[58] Field of Search ..... 123/463, 467, 514, 468, 123/447; 138/30

[56] References Cited

U.S. PATENT DOCUMENTS 2,977,947 4/1961 Carleton ..... 123/463

4,064,854 12/1977 Fehrenbach ..... 123/447

4,205,637 6/1980 Ito ..... 123/447

4,373,822 2/1983 Kemmer ..... 123/447

FOREIGN PATENT DOCUMENTS 0005429 1/1980 Japan ..... 123/463

*Primary Examiner*—Carl Stuart Miller

*Attorney, Agent, or Firm*—Edwin E. Griegg

[57] ABSTRACT

A pressure regulating device is proposed which regulates the fuel pressure in a fuel injection system for internal combustion engines. The pressure regulating device includes a pressure regulating valve which has a valve diaphragm fastened in a valve housing and arranged to define a fuel chamber which communicates via inlet pipes with a fuel distributor line. Protruding into the fuel chamber is a valve seat body joined to the valve housing, on one end of which body a valve seat is formed and the other end of which engages an outlet conduit which protrudes through the wall of the fuel distributor line remote from the pressure regulating valve and is tightly joined to this wall.

13 Claims, 2 Drawing Sheets

38
39
18
35
41
40
37
42
36
29
27
17
23
20
31
24
26
22
15
33
21
30
1
19
4
3
7
6
8
28
5
16
30
28
32
13
9
11
10
12
2

PRESSURE REGULATING DEVICE

BACKGROUND OF THE INVENTION

The invention is based on a pressure regulating device as generally defined hereinafter. A pressure regulating device is already known in which a plug connection between a part that has two separate conduits on the one hand and a pressure regulating valve on the other is possible. This kind of embodiment is not, however, suitable for providing a connection between a fuel distributor line and a pressure regulating valve.

OBJECT AND SUMMARY OF THE INVENTION

The pressure regulating device according to the invention has the advantage not only that the fuel distributor line and the pressure regulating valve are simple in structure, but also that it is relatively simple to mount the pressure regulating valve on the fuel distributor line; also, little space is required.

Among further advantageous features of the pressure regulating valve according to the invention are that for the sake of simple assembly, not only can the inlet pipes be joined to the valve housing, but the various pipes can be molded onto the valve housing. A particularly simple embodiment is attained if the valve housing and the fuel distributor line are soldered together, thereby obviating seals and screws.

The invention will be better understood and further objects and advantages thereof will become apparent from the ensuing detailed description of preferred embodiments taken in conjunction with the drawings.

DESCRIPTION OF THE PREFERRED EMBODIMENTS

Figure 1:
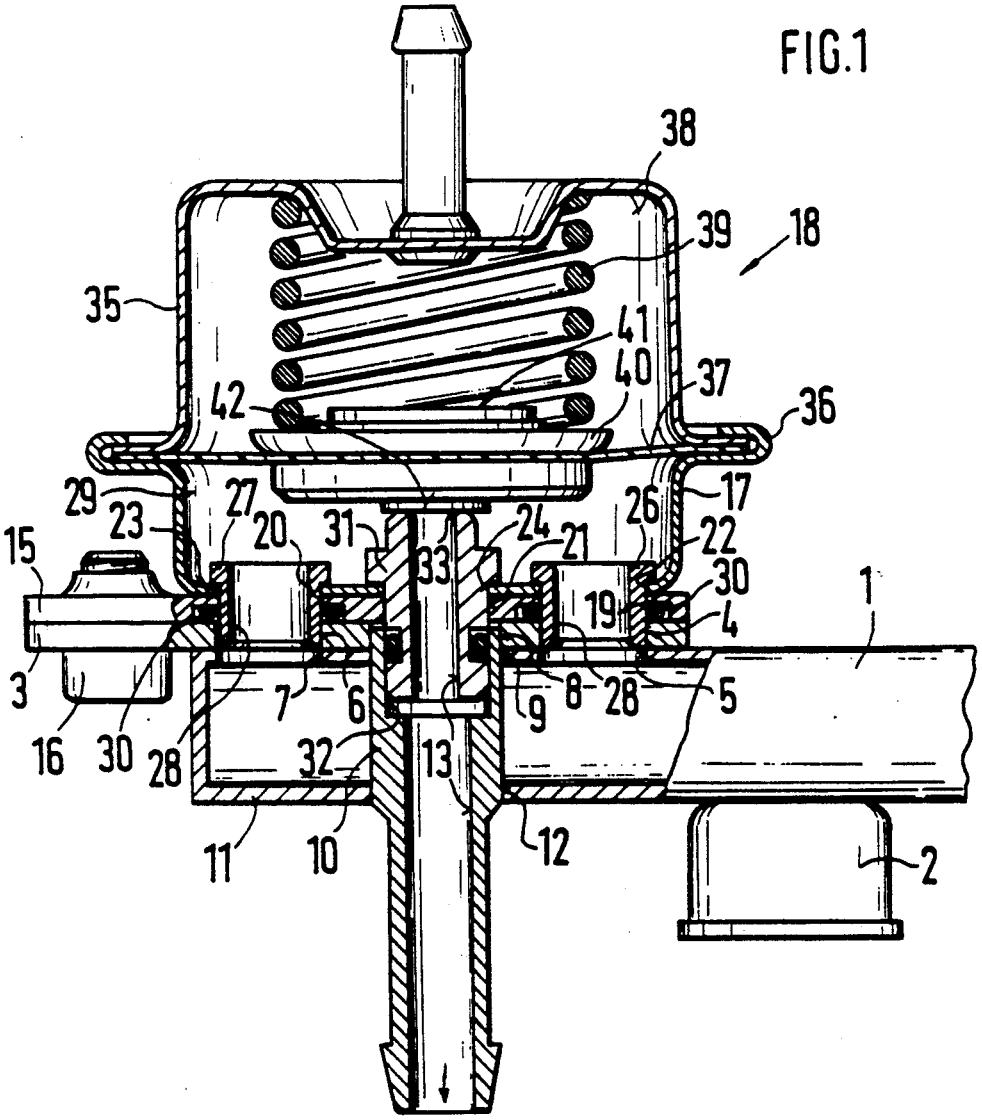
FIG. 1 shows in cross section a first exemplary embodiment of a pressure regulating device.

FIG. 1 shows a rigid fuel distributor line 1, for instance made of metal, for a fuel injection system of internal combustion engines, which has a plurality of plug connections 2, into which the fuel injection valves are inserted with one end. Joined to the wall of the fuel distributor line 1, for instance by soldering, is a securing flange 3, in which a first through opening 4, which coincides with a first opening 5 in the fuel distributor line 1, and a second through opening 6, which coincides with a second opening 7 in the fuel distributor line 1, are provided. The openings 5 and 7 in the fuel distributor line 1 are located along the longitudinal axis of the fuel distributor line, spaced axially apart from one another. Between the first through opening 4 and the second through opening 6 of the securing flange 3, a third through opening 8 is provided along the longitudinal axis of the fuel distributor line 1; this opening 8 being arranged to coincide with a third opening 9 in the fuel distributor line. An outlet pipe 10 is tightly inserted into the third through opening 8 of the securing flange 3 and into the third opening 9 of the fuel distributor line 1 and is joined to the fuel distributor line 1 and/or the securing flange 3. The outlet pipe 10 projects through the fuel distributor line 1 and in the wall 11 of the fuel distributor line 1 remote from the securing flange 3 penetrates a fourth opening 12, in which it is tightly secured, for instance by soldering. The outlet pipe 10 is penetrated in the axial direction by an outlet conduit 13, which leads in a manner not shown to a fuel container or to the intake side of a fuel feed pump. The fuel distributor line 1 communicates with a fuel supply line, which is connected to the pumping outlet of a fuel feed pump.

Remote from the fuel distributor line 1, a securing flange 15 rests on the securing flange 3 and is joined to it by means of screws 16. The securing flange 15, in turn, is secured to a bottom part 17 of a pressure regulating valve 18, for instance by soldering. Insertion openings 19, 20, 21 in the securing flange 15 and insertion openings 22, 23, 24 in the bottom part 17 are in alignment with the through openings 4, 6, 8. One inlet pipe 26, 27 is inserted into each of the insertion openings 22, 23 of the bottom part 17 and soldered or welded to the bottom part 17. Each inlet pipe 26, 27 protrudes through the associated insertion opening 19 or 20 in the securing flange 15 and terminates in the associated through opening 4 or 6 of the securing flange 3. An inlet conduit 28 is embodied in each inlet pipe 26, 27, thereby joining the fuel distributor line 1 to a fuel chamber 29 of the pressure regulating valve 18. The insertion openings 19 and 20 in the securing flange 15 are stepped in shape and have a larger diameter toward the securing flange 3 than toward the bottom part 17, so as to receive sealing rings 30 which surround each inlet pipe 26 and 27. A valve seat body 31 is inserted into the insertion openings 21 and 24 of the securing flange 15 and bottom part 17, respectively, and is thereafter soldered or welded to the bottom part 17. With one end, the valve seat body 31 protrudes in a sealed manner into a receiving bore 32 of the outlet pipe 10, while its other end protrudes into the fuel chamber 29 and terminates there, forming a valve seat 33. Beginning at the valve seat 33, the outlet conduit 13 leads through the valve seat body 31 to the outlet conduit 10.

Between the bottom part 17 and a cover element 35 of the pressure regulating valve 18, a resilient valve diaphragm 37 is fastened by means of a crimped area 36, which divides the fuel chamber 29 from a spring chamber 38 within the pressure regulating valve 18. A compression spring 39 is disposed in the spring chamber 38, being supported at one end on the cover 35 and at the other on a spring support plate 40, which is secured to the valve diaphragm by means of a rivet connection 41 which passes in a sealed manner through the valve diaphragm 37. The rivet connection 41 which is adapted to extend from an area beneath the cover 35 into the fuel chamber 29 is provided with a valve plate 42 that cooperates with the valve seat 33 and is urged in the direction toward the valve seat 33 by the compression spring 39. If the fuel pressure in the fuel distributor line and hence in the fuel chamber 29 as well rises above a value that is predetermined by the force of the compression spring 39, then the valve plate 42 is raised from the valve seat 33, and fuel can flow out via the outlet conduit 13. The pressure regulating device according to the invention permits a space-saving structure and rapid assembly of the fuel distributor line 1 and pressure regulating valve 18.

Figure 2:
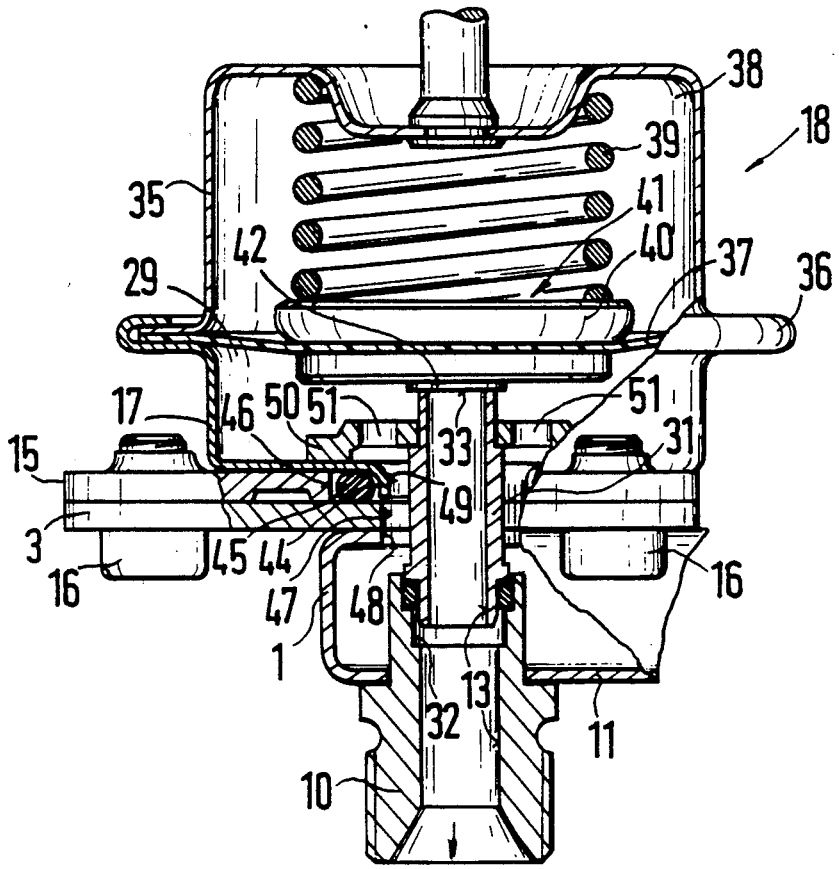
FIG. 2 also shows in cross section a second exemplary embodiment of a pressure regulating device.

In the second exemplary embodiment according to FIG. 2, elements remaining the same as and functioning like those of the exemplary embodiment of FIG. 1 are identified by the same reference numerals. Differing from the exemplary embodiment of FIG. 1, the pressure regulating valve 18 of FIG. 2 has an integral molded inlet pipe 44, which is surrounded by a sealing ring 45 and is arranged to protrude into an insertion opening 46 of the securing flange 15. An inlet conduit 49 which is substantially aligned with a through opening 47 in the securing flange 3 and with an opening 48 in the fuel distributor line 1 is provided in the inlet pipe 44. The valve seat body 31 is adapted to protrude with radial play through the inlet conduit 49 of the inlet pipe 44 and is retained in the fuel chamber 29 by means of a retaining plate 50 that is joined to the bottom part 17; on the other end, the valve seat body 31 is adapted to protrude in a sealed manner into the receiving bore 32 of the outlet pipe 10. In this exemplary embodiment, the outlet pipe 10 terminates within the fuel distributor line 1, spaced apart from the wall thereof oriented toward the securing flange 3, so that an annular cross section is formed between the circumference of the valve seat body 31 and the wall of the inlet conduit 49, the opening 48 and the through opening 47, by way of which annular cross section fuel can flow out of the fuel distributor line into the fuel chamber 29. To this end, flow openings 51 are formed in the retaining plate 50. As a result of the concentric arrangement of the inlet pipe 44 and outlet pipe 10, this exemplary embodiment has a particularly compact structure.

Figure 3:
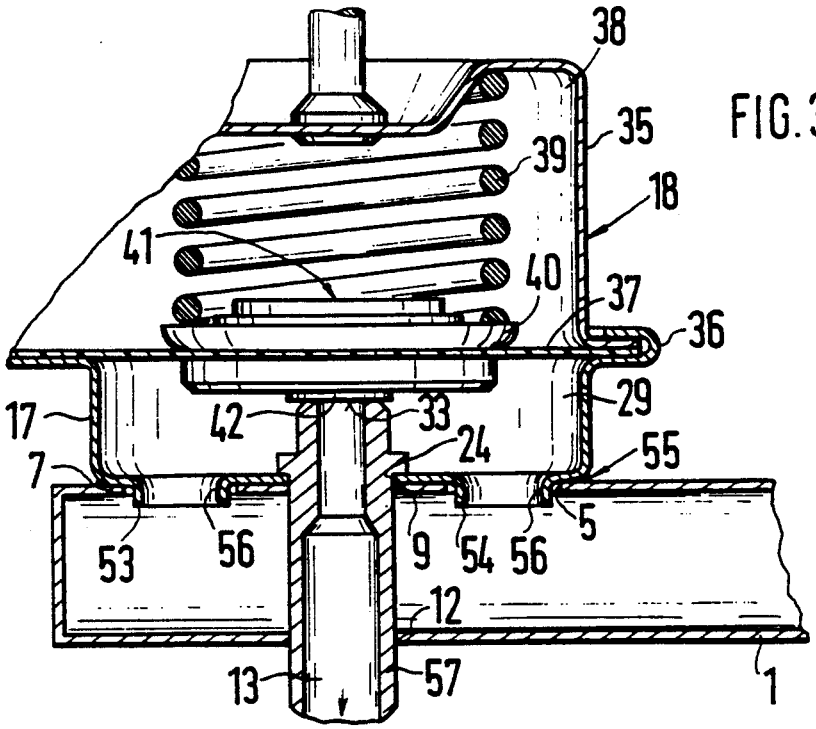
FIG. 3 shows additional in cross section a third exemplary embodiment of a pressure regulating device.

In the third exemplary embodiment shown in FIG. 3, elements remaining the same as and functioning like those of the other embodiments shown in FIGS. 1 and 2 are identified by the same reference numerals. Differing from the foregoing embodiments, the securing flanges 3, 15 and the screws 16 are omitted in the exemplary embodiment of FIG. 3. The inlet pipes 53 and 54, which are molded integrally with the bottom part 17, are arranged to protrude directly into the openings 5 and 7 of the fuel distributor line 1, and the bottom part 17 is soldered directly to the fuel distributor line 1 as shown at 55 in the plane defined by these two parts in such a manner that a fuel-tight connection is attained between the surfaces of the fuel distributor line 1 and the bottom part 17. Inlet conduits 56–56 are provided in the inlet pipes 53, 54, by way of which fuel can flow from the fuel distributor line 1 into the fuel chamber 29. The outlet pipe 57 forms a valve seat 33 at one end and protrudes through an insertion opening 24 in the bottom part 17 and an opening 9 and an opening 12 in the fuel distributor line and tightness is assured by carefully soldering the parts together.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A pressure regulating device comprising a rigid fuel distributor line for supplying fuel to fuel injection valves of an internal combustion engine, a pressure regulating valve disposed on and joined to said rigid fuel distributor line, said pressure regulating valve further including a valve housing sub-divided by a flexible wall into a respective spring chamber and a fuel chamber, said flexible wall having a valve closing means which may seat on a valve seat, at least one means defining an inlet opening to said fuel chamber arranged to join said pressure regulating valve to said fuel distributor line, an outlet conduit in proximity to said inlet opening which receives fuel flow via said valve seat, said outlet conduit extends through opposite disposed walls of said fuel distributor line whereby fuel is returned to supply, and means to secure said outlet conduit to each of said oppositely disposed walls of said fuel distributor line through which said outlet conduit extends.

2. A pressure regulating device comprising a rigid fuel distributor line for supplying fuel to fuel injection valves of an internal combustion engine, a pressure regulating valve disposed on and joined to said rigid fuel distributor line, said pressure regulating valve further including a valve housing sub-divided by a flexible wall into a respective spring chamber and a fuel chamber, a valve seat body, a valve seat embodied on said valve seat body, said flexible wall having a valve closing means which may seat on said valve seat, at least one means defining an inlet opening to said fuel chamber arranged to join said pressure regulating valve to said fuel distributor line, an outlet conduit that extends through said fuel distributor line in proximity to said at least one means defining said inlet opening, means to secure said outlet conduit to at least one oppositely disposed wall of said fuel distributor line through which said outlet conduit extends, said valve seat body is joined by an end portion thereof to an end portion of said outlet conduit in a sealed manner whereby fuel flow received by said fuel chamber is returned to supply via said valve seat, said valve seat body and said outlet conduit.

3. A pressure regulating device as defined by claim 1, further wherein said means defining said inlet opening is embodied in at least one inlet conduit joined to said valve housing.

4. A pressure regulating device as defined by claim 3, further wherein said inlet conduit is molded onto said valve housing.

5. A pressure regulating device as defined by claim 3, further wherein a seal means is disposed between said valve housing and said fuel distributor line.

6. A pressure regulating device as defined by claim 4, further wherein a seal means is disposed between said valve housing and said fuel distributor line.

7. A pressure regulating device as defined by claim 2, further wherein said inlet conduit is disposed concentrically with said outlet conduit.

8. A pressure regulating device as defined by claim 1, further wherein said pressure regulating valve and said fuel distributor line are joined to one another by a screw connection.

9. A pressure regulating device as defined by claim 1, further wherein said valve housing is soldered to said fuel distributor line.

10. A pressure regulating device as defined in claim 3, further wherein said valve housing is soldered to said fuel distributor line.

11. A pressure regulating device as defined by claim 4, further wherein said valve housing is soldered to said fuel distributor line.

12. A pressure regulating device as defined by claim 5, further wherein said valve housing is soldered to said fuel distributor line.

13. A pressure regulating device as defined by claim 1, further wherein said valve seat is embodied on said outlet conduit.

* * * * *